US010258526B2

(12) United States Patent
Geiselman, III

(10) Patent No.: US 10,258,526 B2
(45) Date of Patent: Apr. 16, 2019

(54) REHABILITATION LIFTING AND LOWERING AID

(71) Applicant: Grover J. Geiselman, III, Richmond, TX (US)

(72) Inventor: Grover J. Geiselman, III, Richmond, TX (US)

( * ) Notice: Subject to any disclaimer, the term of this patent is extended or adjusted under 35 U.S.C. 154(b) by 0 days.

(21) Appl. No.: 15/360,970

(22) Filed: Nov. 23, 2016

(65) Prior Publication Data

US 2018/0140487 A1 May 24, 2018

(51) Int. Cl.
*A61G 7/10* (2006.01)

(52) U.S. Cl.
CPC ..... *A61G 7/1019* (2013.01); *A61G 7/1011* (2013.01)

(58) Field of Classification Search
CPC ..... A61G 5/14; A61G 5/1059; A61G 5/1056; A47C 3/20; A47C 3/36; B60N 2/16
USPC ..... 297/344.17, 344.1, 344.12, 344.15
See application file for complete search history.

(56) References Cited

U.S. PATENT DOCUMENTS 4,010,499 A * 3/1977 Davis ..... A61G 7/10 280/47.38
4,415,202 A * 11/1983 Pew ..... A61G 5/00 280/304.1
5,800,016 A * 9/1998 Allred ..... A61G 5/1059 248/421
5,816,655 A * 10/1998 Hoegh ..... A61G 5/1059 297/338
6,935,648 B2 * 8/2005 Beck ..... A61G 5/1059 280/250.1
8,840,175 B2 * 9/2014 Short ..... A47B 85/04 297/119
9,713,560 B1 * 7/2017 Raymond ..... A61G 5/14
2006/0238007 A1 * 10/2006 Lin ..... A47C 1/0355 297/330
2007/0067905 A1 * 3/2007 Wilder ..... A61G 7/1011 5/83.1
2009/0284037 A1 * 11/2009 Wang ..... A61G 5/08 296/65.05
2010/0327557 A1 * 12/2010 Wang ..... A61G 5/045 280/304.1
2015/0137567 A1 * 5/2015 Smith ..... A61G 5/1059 297/183.1
2015/0202102 A1 * 7/2015 Dunham ..... A61G 5/1059 297/344.13
2016/0051426 A1 * 2/2016 Hall ..... B66F 3/247 254/93 HP
2016/0338893 A1 * 11/2016 Tu ..... H01H 13/705

* cited by examiner

*Primary Examiner* — Mark R Wendell
(74) *Attorney, Agent, or Firm* — Rao DeBoer Osterrieder, PLLC; Dileep P. Rao

(57) ABSTRACT

A rehabilitation aid for lowering a person to the floor, or lifting a person from the floor. The lifting device comprises a base for resting upon a support surface, a seating surface configured to support a person, an elevator mechanism in mechanical communication with the base and the seating surface for raising and lowering the seating surface, and a back rest arranged substantially orthogonally proximate the seating surface.

7 Claims, 4 Drawing Sheets

REHABILITATION LIFTING AND LOWERING AID

FIELD

The present embodiments generally relate to a lifting device to aid in maneuvering a patient during the rehabilitation of the patient.

BACKGROUND

Persons who have suffered injuries often are prescribed physical therapy exercises as treatments and to aid in their recovery. Often, exercises are performed while lying or kneeling on an exercise mat, the ground, or some other support structure.

Frequently, the injury being treated itself will make achieving a sitting or standing position either painful or impossible upon completion of rehabilitation or physical therapy exercises. Conversely, the injury may make achieving a prone position or lowering to a support surface to perform exercises a difficult proposition.

Therefore, a need exists for an aid to help a person achieve a sitting position or a standing position without undue exertion or pain. Further, a need exists for a device capable of aiding a person to achieve a seated position from floor level. In addition, a need exists for a device that can lower a person safely to the floor.

The present invention meets these needs.

BRIEF DESCRIPTION OF THE DRAWINGS

The detailed description will be better understood in conjunction with the accompanying drawings as follows.

Figure 1B:
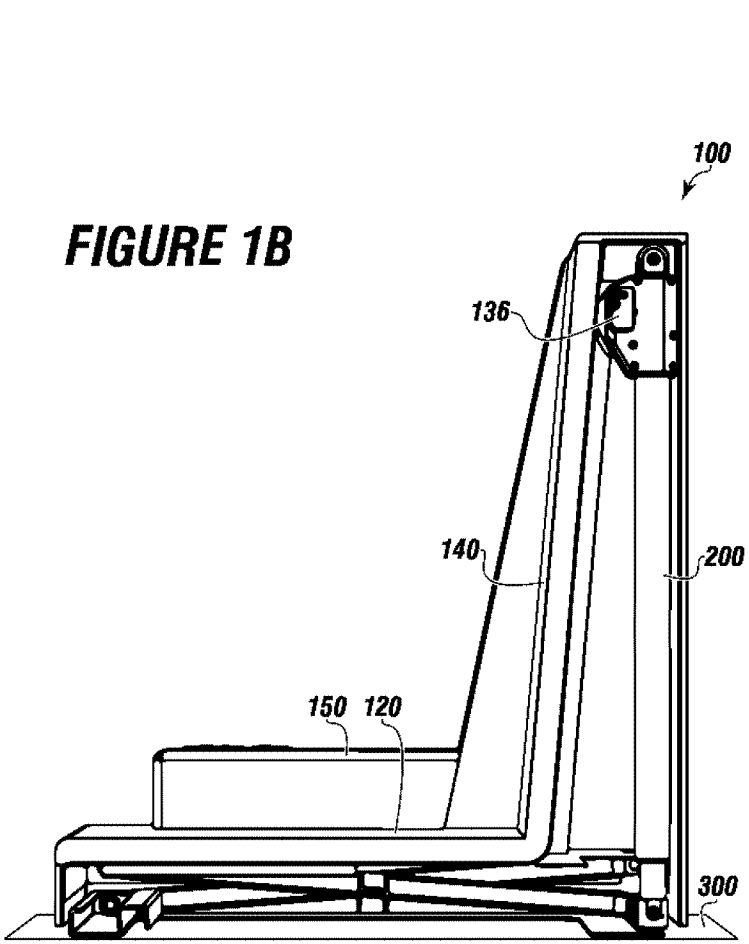
FIG. 1B depicts one embodiment of the lifting device in a side cut view in a lowered position according to one or more embodiments.

The present embodiments are detailed below with reference to the listed Figures.

DETAILED DESCRIPTION OF THE EMBODIMENTS

Before explaining the present invention in detail, it is to be understood that the invention is not limited to particular embodiments and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting. Specific structural and functional details disclosed herein are not to be interpreted as limiting, but merely as a basis of the claims and as a representative basis for teaching persons having ordinary skill in the art to variously employ the present invention. Many variations and modifications of embodiments disclosed herein are possible and are within the scope of the disclosure.

Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description herein, but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

While many aids exist for persons to exercise, rehabilitate, and retain or achieve mobility, no device is presently known to exist which can allow a person on the floor to be raised to a seated position.

The present invention allows for a person on the floor to seat themselves upon a seating surface, and then be raised to a comfortable seated height. Further, the present invention allows for a person to be safely lowered to the floor from a seated position.

The present invention is a lifting device comprising a base for resting upon a support surface, a seating surface configured to support a person, an elevator mechanism in mechanical communication with the base and the seating surface for raising and lowering the seating surface, and a back rest arranged substantially orthogonally proximate the seating surface.

The base of the device is intended to rest upon a support surface, such as a floor, an exercise mat, and the like. The base is intended to provide stability to the overall structure of the device.

In embodiments, the base may have a non-slip coating or have some non-slip materials attached to the base. Alternatively, the base can be designed for use upon a non-slip support surface, such as a mat with a non-slip surface. It will be readily apparent to persons having ordinary skill in the art that it is often desirable for the base to be stationary and stable during the operation of the device.

In embodiments, the base may be weighted or otherwise fixed to remain stationary during the operation of the structure.

The seating surface can be configured to support a person. Various sizes and materials can be selected for the seating surface based upon the intended use of the device. For example, smaller and lighter materials may suffice when a child is the intended user or reinforced and strengthened materials can be used when adults are the intended user.

Uniquely, the seating surface of the device can be lowered from a seated height completely to the support surface upon which the device rests. This provides an easily negotiable surface for a person on the support surface to seat themselves upon. Conversely, the person can be safely lowered to the support surface.

Once a person is seated upon the seating surface, an elevator mechanism can be activated to raise the seating surface to a comfortable and desired seated height. In embodiments, the elevator mechanism can comprise a motor and one or more guide bars which communicate with one or more guide channels in the base.

The guide channels can restrict the movement of the guide bars to maintain the seating surface in a substantially horizontal orientation during raising and lowering.

In embodiments, one or more wheels can be attached to the base for porting the lifting device. The seating surface can be configured to be folded substantially parallel to the back rest to aid in portability of the lifting device.

Various safety accommodations can be added to the device. For example, armrests can be added to the lifting device to provide a grasping point for the person using the device. In embodiments, a control mechanism for raising and lowering the seating surface can be incorporated into the armrest.

An elevator mechanism can be in mechanical communication with the base and the seating surface to raise and lower the seating surface. In embodiments, one or more guide bars and a motor can be included in the elevator mechanism. In embodiments, the guide bars can be in mechanical communication with guide channels situated in the base.

Persons having ordinary skill in the art will recognize that various elevator mechanism can be selected based upon a specific application. Where weight and portability is a concern, a mechanism such as that shown in the figures below may be selected. However, various mechanisms currently known in the art can be substituted while in keeping with the principle of the disclosed invention.

Figure 1A:
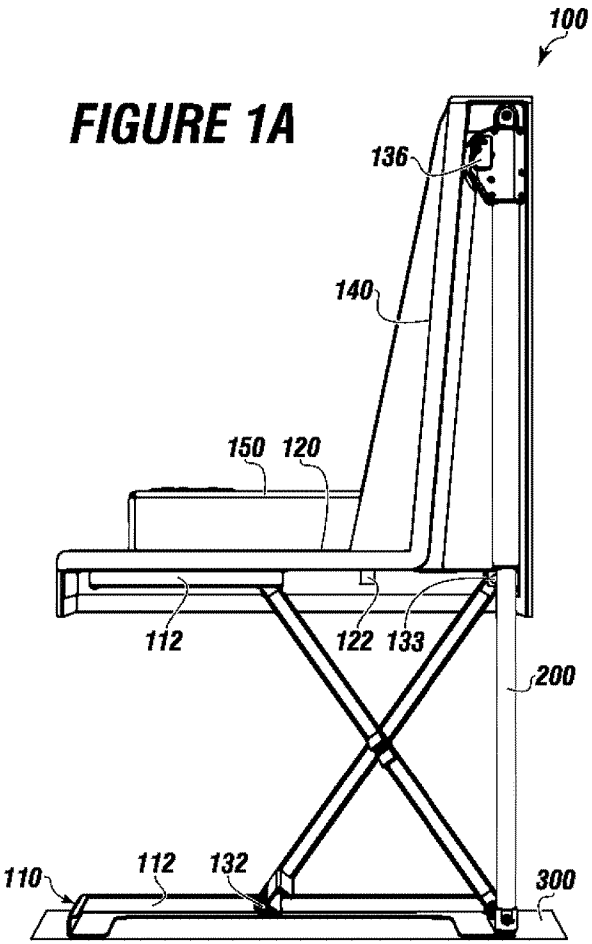
FIG. 1A depicts one embodiment of the lifting device in a side cut view in a raised position according to one or more embodiments.

Turning now to the figures, FIG. 1A depicts one embodiment of the lifting device in a side cut view in a raised position.

The lifting device 100 can have a base 110 for resting upon a support surface 300 such as a floor or an exercise mat. In embodiments the base 110 can be weighted to maintain a stable position for the lifting device. Any suitable material can be selected for the base, such as aluminum for applications in which a light weight is desirable, or steel for applications where greater strength is required.

The lifting device 100 can have a seating surface 120 capable of supporting a person. The seating surface can be sized according to the application. For example a smaller surface area would be required for children as opposed to adults.

In embodiments, the seating surface 120 can have a sensor mounted underneath to provide various data. Exemplary sensors include motion sensors, heat sensors, line of sight sensors, and the like. Such sensors can be employed as an added safety measure to detect when an object impedes the free movement of the seating surface 120.

The base 110 can be designed in such a manner that it does not interfere with the seating surface 120 from being lowered to rest completely upon the support surface.

A back rest 140 can be included to support a person and prevent accidents such as a person falling off the rear of the device. Various other safety mechanisms can be attached such as armrest 150, as dictated by the application. Persons having ordinary skill in the art will be readily able to select such devices.

An elevator mechanism 130 can be included to raise and lower the seating surface. While a motor with a screw lift is depicted, various means of raising the seating surface can be employed. Exemplary methods include motors coupled with worm gears or other gearing mechanisms, independent motors acting on either side of the seating surface, hydraulic lifts, and the like.

The currently depicted elevator mechanism can be selected for limiting the weight of the lifting device and maximizing its portability. Shown in this view is a gearing mechanism 136 and a support 200.

In embodiments, the elevator mechanism 130 can further comprise a guide bar 132 to maintain the seating surface in a substantially horizontal orientation. In embodiments, the base 110 and the seating surface 120 can each comprise a guide channel 112 to restrict the movement of guide bar 132 and aid in maintaining the seating surface in a substantially horizontal orientation. In embodiments, the base 110 and the seating surface 120 can each comprise a fixed attachment point for the guide bar 132.

A control mechanism 160 can be attached to allow a person to raise and lower the lifting device while seated. In embodiments, the control mechanism can be a remote device to allow for another individual, such as a physical therapist, to control the lifting device.

FIG. 1B depicts one embodiment of the lifting device in a side cut view in a lowered position according to one or more embodiments.

Uniquely, the seating surface 120 of the lifting device 100 can be lowered to rest upon the support surface 300 on which it is being used (i.e. a floor). This allows for a person to easily climb into the device and be aided to stand from a prone position.

Figure 2C:
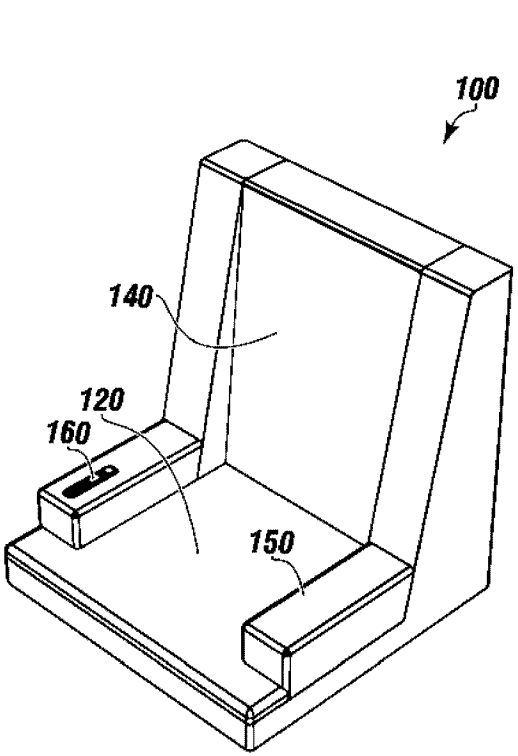
FIG. 2C depicts one embodiment of the lifting device in a perspective view in a lowered position according to one or more embodiments.
Figure 2B:
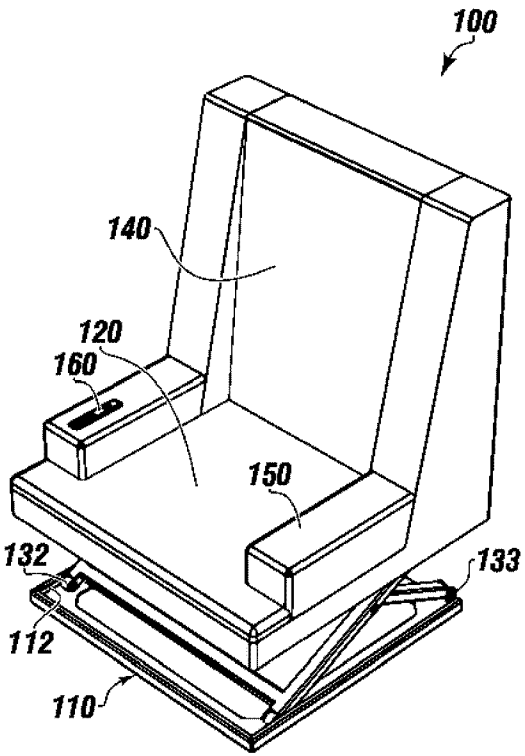
FIG. 2B depicts one embodiment of the lifting device in a perspective view in an intermediate position according to one or more embodiments.
Figure 2A:
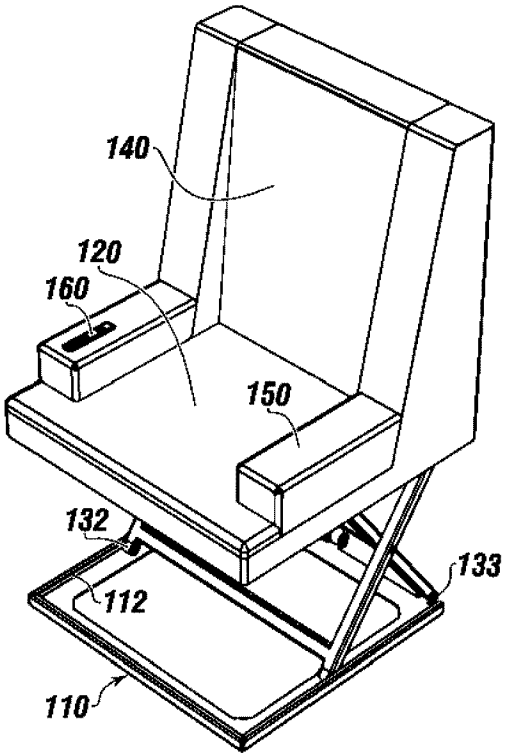
FIG. 2A depicts one embodiment of the lifting device in a perspective view in a raised position according to one or more embodiments.

FIG. 2A depicts one embodiment of the lifting device in a perspective view in a raised position according to one or more embodiments.

Various heights can be selected based upon the application for the lifting device. For example, devices designed for children would not need to rise as high as devices designed for adults.

The control mechanism 160 is more evident in this view. The control mechanism can be sized with large spaces between the action buttons, allowing the device to be easily manipulated by persons wearing prosthetic devices. Further, in embodiments, the control mechanism may be required to be continuously pressed to allow the movement of the lifting device to be rapidly halted in the event of an emergency.

Other safety features may include a skirt to be attached to the seating surface and the base to hide the inner workings of the device and discourage pets or children from entering or reaching into the area.

FIG. 2B depicts one embodiment of the lifting device in a perspective view in an intermediate position according to one or more embodiments.

FIG. 2C depicts one embodiment of the lifting device in a perspective view in a lowered position according to one or more embodiments.

Figure 3:
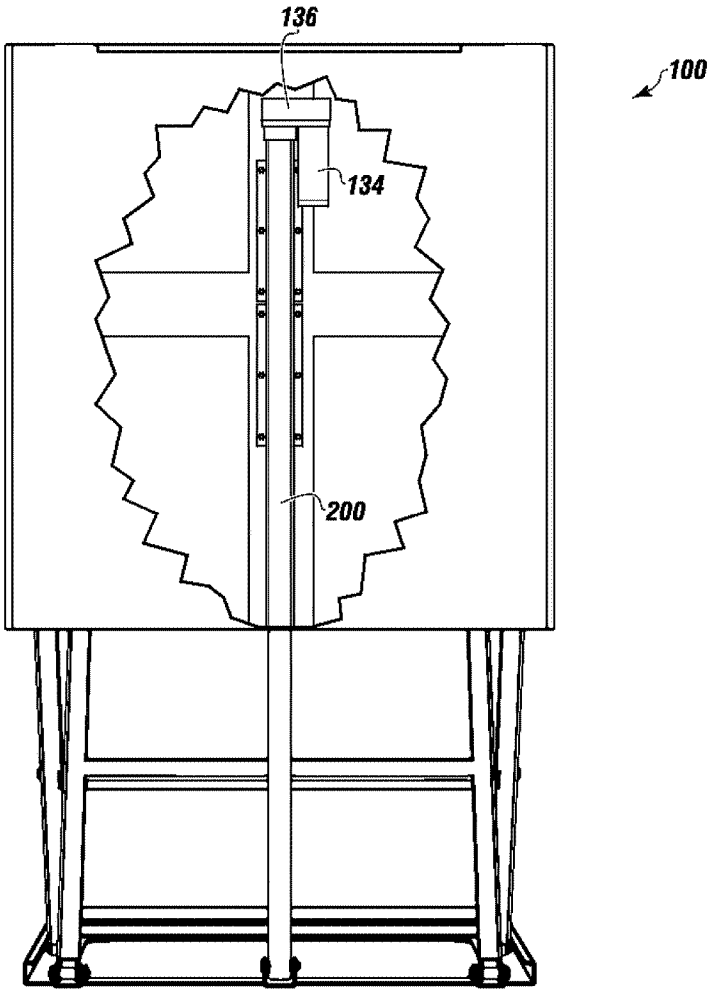
FIG. 3 depicts one embodiment of the lifting device in a rear view in a raised position according to one or more embodiments.

FIG. 3 depicts one embodiment of the lifting device in a rear view in a raised position according to one or more embodiments.

Here a motor 134 with a screw gear 136 in communication with a support 200 has been utilized to control the raising and lowering of the lifting device.

Figure 4:
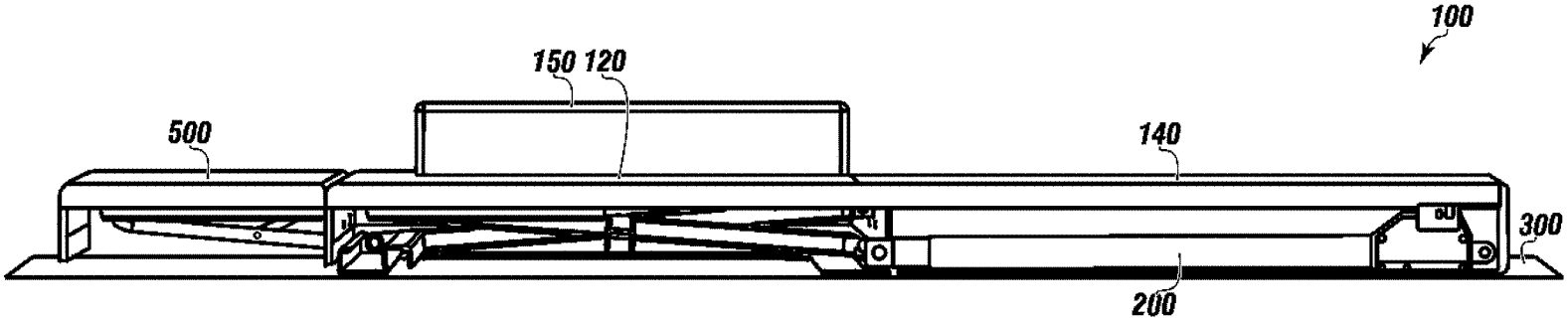
FIG. 4 depicts an alternate embodiment of the lifting device according to one or more embodiments.

FIG. 4 depicts an alternate embodiment of the lifting device according to one or more embodiments.

In this embodiment back rest 140 and leg rest 500 can lay flat upon the support surface to allow for exercising upon the lifting device 100.

In this embodiment, there is a leg support and a back support which can lay flat when lowered to provide an exercise surface for the user.

While these embodiments have been described with emphasis on the presented Figures, it should be understood that within the scope of the appended claims, the embodiments might be practiced other than as specifically enabled herein.

What is claimed is:

1. A lifting device comprising:

a) a base for resting upon a support surface;

b) a seating surface configured to support a person;

c) an elevator mechanism in mechanical communication with the base and the seating surface for vertically raising and lowering the seating surface, wherein the base remains resting upon the support surface, and further wherein the entire lifting mechanism is situated beneath the seating surface; and d) a back rest arranged substantially orthogonally proximate the seating surface; and wherein the seating surface is configured to be lowerable to rest on the support surface, and further wherein the seating surface is configured to be raiseable to a desired seated height.

2. The lifting device of claim 1, further comprising a wheel attached to the base for porting the lifting device.

3. The lifting device of claim 1, wherein the elevator mechanism comprises:

a) a guide bar; and b) a motor.

4. The lifting device of claim 3, wherein the base further comprises a guide channel to restrict the movement of the guide bar.

5. The lifting device of claim 1, wherein the seating surface is configured to be folded substantially parallel to the back rest.

6. The lifting device of claim 1, further comprising a control mechanism for the elevator mechanism.

7. The lifting device of claim 1, further comprising a skirt attached to the seating surface and the base.

* * * * *